US009236235B2

(12) United States Patent
Muntean et al.

(10) Patent No.: US 9,236,235 B2
(45) **Date of Patent: *Jan. 12, 2016**

(54) CURVED ION GUIDE AND RELATED METHODS

(75) Inventors: Felician Muntean, Danville, CA (US); Urs Steiner, Sunnyvale, CA (US)

(73) Assignee: AGILENT TECHNOLOGIES, INC., Santa Clara, CA (US)

( * ) Notice: Subject to any disclaimer, the term of this patent is extended or adjusted under 35 U.S.C. 154(b) by 801 days.

This patent is subject to a terminal disclaimer.

(21) Appl. No.: 12/277,198

(22) Filed: Nov. 24, 2008

(65) Prior Publication Data

US 2009/0294663 A1 Dec. 3, 2009

Related U.S. Application Data

(60) Provisional application No. 61/057,750, filed on May 30, 2008.

(51) Int. Cl.
*H01J 49/06* (2006.01)

(52) U.S. Cl.
CPC ..... *H01J 49/063* (2013.01)

(58) Field of Classification Search
USPC ..... 250/281, 282, 283, 294, 296, 298, 250/396 R, 396 ML
See application file for complete search history.

(56) References Cited

U.S. PATENT DOCUMENTS

| | | | |
|---|---|---|---|
| 3,410,997 | A | 11/1968 | Brubaker |
| 3,473,020 | A | 10/1969 | Brubaker |
| 4,866,279 | A | 9/1989 | Schelten et al. |
| 5,559,327 | A | 9/1996 | Steiner |
| 5,825,026 | A | 10/1998 | Baykut |
| 5,847,386 | A | 12/1998 | Thomson et al. |
| 6,525,314 | B1 | 2/2003 | Jarrell et al. |
| 6,576,897 | B1 | 6/2003 | Steiner et al. |
| 6,891,157 | B2 | 5/2005 | Bateman et al. |
| 7,166,836 | B1 | 1/2007 | Russ et al. |

(Continued)

FOREIGN PATENT DOCUMENTS

| | | |
|---|---|---|
| JP | 10302709 | 11/1998 |
| JP | 2000268770 | 3/1999 |

(Continued)

OTHER PUBLICATIONS

European Patent Office, Search Report under Rule 62 EPC dated Dec. 22, 2010 in Application No. EP09000965.

(Continued)

*Primary Examiner* — Nicole Ippolito
*Assistant Examiner* — Hanway Chang

(57) ABSTRACT

An ion guide includes a plurality of curved electrodes and an ion deflecting device. The electrodes are arranged in parallel with each other and with a central curved axis, the curved central axis being co-extensive with an arc of a circular section having a radius of curvature, each electrode being radially spaced from the curved central axis, wherein the plurality of electrodes define a curved ion guide region arranged about the curved central axis and between opposing pairs of the electrodes. The ion deflecting device may include a device for applying a DC electric field to two or more of the electrodes in a radial direction. The ion deflecting device may include a pair of curved, parallel ion deflecting electrodes, which are in addition to curved electrodes utilized for applying an RF ion guiding field.

21 Claims, 5 Drawing Sheets

(56) References Cited

U.S. PATENT DOCUMENTS

| | | | | |
|---|---|---|---|---|
| 7,365,317 | B2 | 4/2008 | Whitehouse et al. | |
| 2002/0014587 | A1 | 2/2002 | Benveniste et al. | |
| 2004/0227074 | A1 | 11/2004 | Benveniste et al. | |
| 2006/0011828 | A1* | 1/2006 | Livi | 250/288 |
| 2007/0138383 | A1 | 6/2007 | Dowell et al. | |
| 2008/0061229 | A1 | 3/2008 | Burch | |
| 2008/0067365 | A1 | 3/2008 | Thakur et al. | |
| 2008/0116371 | A1 | 5/2008 | Wouters et al. | |
| 2009/0095898 | A1 | 4/2009 | Collings et al. | |
| 2009/0294663 | A1 | 12/2009 | Muntean et al. | |
| 2010/0301227 | A1* | 12/2010 | Muntean | 250/396 R |

FOREIGN PATENT DOCUMENTS

| | | |
|---|---|---|
| JP | 2000243347 | 9/2000 |
| JP | 2004520685 | 7/2004 |
| WO | WO2008067331 | 6/2008 |

OTHER PUBLICATIONS

International Search Report & Written Opinion mailed Jan. 20, 2011 in International Application No. PCT/US2010/036738.

* cited by examiner

CURVED ION GUIDE AND RELATED METHODS

RELATED APPLICATION

This application claims the benefit of U.S. Provisional Patent Application Ser. No. 61/057,750, filed May 30, 2008.

FIELD OF THE INVENTION

The present invention relates generally to the guiding of ions which finds use, for example, in fields of analytical chemistry such as mass spectrometry. More particularly, the present invention relates to the guiding of ions along a curved path while also subjecting the ions to a deflecting electrical field in a radial direction relative to the curved path.

BACKGROUND OF THE INVENTION

An ion guide may be utilized to transmit ions in various types of ion processing devices, one example being a mass spectrometer (MS). The theory, design and operation of various types of mass spectrometers are well-known to persons skilled in the art and thus need not be detailed in the present disclosure. A commonly employed ion guide is based on a multipole electrode structure, which is typically an RF-only electrode structure in which the ions passing through the ion guide are subjected to a two-dimensional RF trapping field that focuses the ions along an axial path through the electrode structure. In a curved ion guide the ion axis along which the ions pass is a curved path rather than a straight path. The curved ion guide is often desirable for implementation in ion processors such as mass spectrometers because it can improve the sensitivity and robustness of the mass spectrometer. A primary advantage of the curved ion guide in such a context is that it provides a line-of-sight separation of the neutral noise, large droplet noise, or photons from the ions, thereby preventing the neutral components from reaching the more sensitive parts of the ion optics and ion detector. Moreover, the curved ion guide enables the folding or turning of ion paths and allows smaller footprints in the associated instruments.

As appreciated by persons skilled in the art, in a curved ion guide the ions are transmitted around a curved ion path through oscillations inside the radial trapping field provided by the RF voltage applied on the rods (i.e., electrodes) of the ion guide. In the absence of the RF field, the ions would move straight and eventually hit the ion guide rods. Therefore, in the curved ion guide the ions need to experience a certain minimum amount of RF restoring force during their flight before they move too close to the ion guide rods and become unstable. When the ion guide transmits one mass at a time, the best performance is obtained when the RF voltage is scanned as a function of mass to optimize transmission. However, it is often desirable to run ions at higher energy and/or transmit ions of multiple different masses (mass-to-charge, or m/z, ratio) simultaneously. In such cases, some of the ions cannot have optimal transmission conditions and they are lost, leading to less than optimal instrument sensitivity.

Accordingly, there continues to be a need for improved curved ion guides, including ion guides capable of transmitting ions at high levels of kinetic energy and simultaneously transmitting ions of multiple masses while maintaining optimized ion transmission conditions.

SUMMARY OF THE INVENTION

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, an ion guide includes a plurality of curved electrodes and an ion deflection device. The curved electrodes are arranged in parallel with each other and with a central curved axis, the curved central axis being co-extensive with an arc of a circular section having a radius of curvature. Each electrode is radially spaced from the curved central axis, wherein the plurality of electrodes define a curved ion guide region arranged about the curved central axis and between opposing pairs of the electrodes. The ion deflecting device is configured for applying a radial DC electric field across the ion guide region and along the radius of curvature.

According to another implementation, a method is provided for guiding an ion through an ion guide. The ion is transmitted into a curved ion guide region of the ion guide. The ion guide region is defined by a plurality of curved electrodes arranged in parallel with each other and with a central curved axis, the curved central axis running through the ion guide region co-extensively with an arc of a circular section having a radius of curvature. Each electrode is radially spaced from the curved central axis, wherein the curved ion guide region is arranged about the curved central axis and between opposing pairs of the electrodes. A radio-frequency electric field is generated across the ion guide region to focus the ion to motions generally along the curved central axis. A radial DC electric field is generated across the ion guide region and along the radius of curvature to provide an ion deflecting force directed along the radius of curvature.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION OF THE INVENTION

The subject matter disclosed herein generally relates to the guiding and deflection of ions and associated ion processing. Examples of implementations of methods and related devices, apparatus, and/or systems are described in more detail below with reference to FIGS. 1-7. These examples are described at least in part in the context of mass spectrometry (MS). However, any process that involves the guiding and deflection of ions may fall within the scope of this disclosure.

Figure 1:
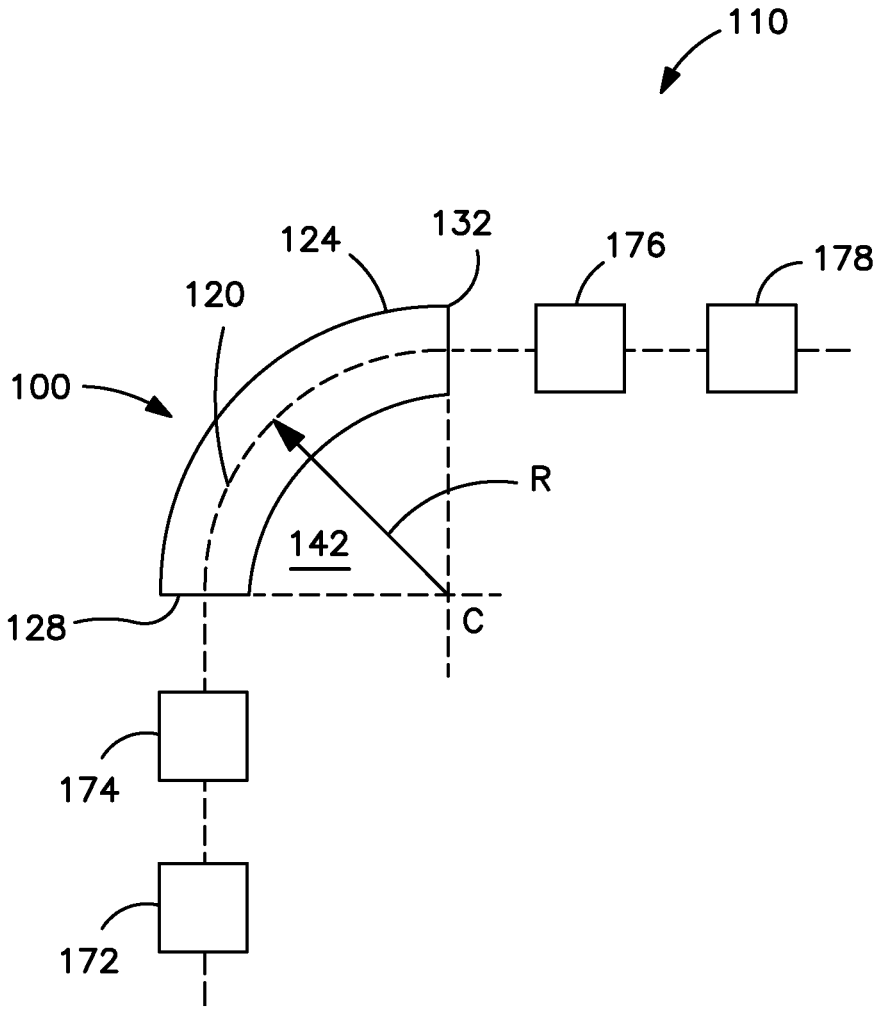
FIG. 1 is a simplified schematic view of an example of an ion guide and an associated ion processing system according to certain implementations of the present disclosure.

FIG. 1 is a schematic view of an example of an ion guide (device, apparatus, assembly, etc.) 100, and further of an example of an ion processing system (or device, apparatus, assembly, etc.) 110 that may include the ion guide 100, according to certain implementations of the present disclosure. The ion guide 100 includes a plurality of curved electrodes (see, e.g., FIG. 2) arranged about a curved central axis 120, which may be referred to as the z-axis. The ion guide 100 may generally include a housing or frame 124, and/or any other structure suitable for supporting the electrodes in a fixed arrangement along the central axis 120. Depending on the type of ion processing system 110 contemplated, the housing 124 may provide an evacuated, low-pressure, or less than ambient-pressure environment. As will become more evident from the description below, the electrodes are generally parallel to each other and to the central axis 120, and are elongated along the central axis 120 in the form of a set of curved rods. By this configuration, the electrodes generally define an interior space within the ion guide 100 that is likewise curved and elongated along the central axis 120. The opposing axial ends of the ion guide 100 respectively serve as an axial ion inlet 128 into the ion guide 100 and an axial ion outlet 132 from the ion guide 100. As appreciated by persons skilled in the art, upon the proper application of RF voltages to the electrodes, the electrodes generate a two-dimensional (x-y plane in the present example), quadrupolar, electrical restoring field that focuses ions generally along a curved path represented by the central axis 120. Owing to the curved geometry of the ion guide 100, the respective axes of the ion inlet 128 and the ion outlet 132 are not collinear. Hence, given the fact that only charged particles are influenced by the RF field, when a particle stream containing ions and neutral particles (e.g., gas molecules, liquid droplets, etc.) enters the ion guide 100 via the ion inlet 128, the ions are constrained to motions in the vicinity of the central axis 120 while the neutrals generally continue on a straight path. Consequently, only ions exit the ion guide 100 via the ion outlet 132.

As also illustrated in FIG. 1, the central axis 120 may be conceptualized as running coextensively along the arc of circular section 142 defined by a center of curvature C and a radius of curvature R, with the radius of curvature R being the radial distance between the central axis 120 and the center of curvature C. Accordingly, the ion guide 100 and its corresponding set of electrodes may be characterized as having this radius of curvature R. It will be understood that the central axis 120 may extend along any length of arc of the circle of which the circular section 142 is a part. For instance, in the illustrated example, the length of the central axis 120 is such as to define a circular section 142 taking up a full quadrant of the circle, in which case the respective axes of the ion inlet 128 and the ion outlet 132 are offset by ninety degrees. Thus, in the present example, the ion guide 100 provides a focused ion beam that is transmitted along an ion path shaped as a ninety-degree elbow. In other examples, however, the length of the central axis 120 may be more or less such that the resulting circular section 142 may be larger or smaller than illustrated, and accordingly the angle between the respective axes of the ion inlet 128 and the ion outlet 132 may be greater or less than ninety degrees.

It will be further understood that the illustrated ion guide 100 may represent a portion or section of a larger ion guide (not shown) that includes one or more additional sections positioned upstream and/or downstream of the illustrated ion guide 100. These additional ion guide sections may also be configured as circular sectors but alternatively may follow linear paths or other types of non-circular paths. Thus, one or more ion guides 100, with or without additional, differently shaped ion guides, may be utilized to provide any desired path for an ion beam focused thereby. Thus, in another non-illustrated example, the ion guide 100 may be shaped so as to provide a 180-degree turn in the focused ion path, i.e., a U-shaped ion path. In another example, the "legs" of the U-shaped path may be extended by providing linear ion guide sections adjacent to the ion inlet and the ion outlet of the U-shaped ion guide. In another example, two 90-degree ion guides 100 may be positioned adjacent to one another to realize the 180-degree turn in the ion path. In another example, two similarly shaped ion guides may be positioned adjacent to one another such that the radius of curvature of one ion guide is directed oppositely to that of the other ion guide, thereby providing an S-shaped ion path. Persons skilled in the art will appreciate that various other configurations may be derived from the present teachings.

Figure 2:
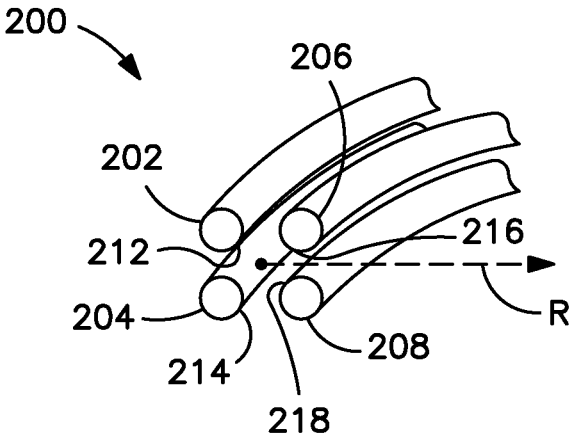
FIG. 2 is a perspective view of an example of a portion of an ion guide according to an implementation of the present disclosure.

FIG. 2 is a perspective view of an example of a portion of an ion guide 200 that includes a set of parallel, curved ion guiding electrodes 202, 204, 206 and 208. The ion guide 200 may, for example, be utilized as the ion guide 100 described above and illustrated in FIG. 1 and as part of the accompanying the ion processing system 110. In this example, the electrode set consists of four electrodes 202, 204, 206 and 208 to form a basic two-dimensional, quadrupolar ion-focusing (or ion-guiding) field. In other implementations, additional electrodes may be included (e.g., a hexapolar or octopolar configuration). Each electrode 202, 204, 206 and 208 is typically spaced at the same radial distance from the central z-axis as the other electrodes 202, 204, 206 and 208, in which case the ion guide 200 may be considered as including a symmetrical arrangement of electrodes 202, 204, 206 and 208. The illustrated electrode set may be considered as including two pairs of opposing electrodes. That is, the electrodes 202 and 208 oppose each other relative to the central z-axis, and the electrodes 204 and 206 oppose each other relative to the central z-axis. Typically, the opposing pair of electrodes 202 and 208 is electrically interconnected, and the other opposing pair of electrodes 204 and 206 is electrically interconnected, to facilitate the application of an appropriate RF voltage signal that drives the two-dimensional ion guiding field as described further below.

In addition, for purposes of describing the presently disclosed implementations, the electrodes 202 and 204 may be considered as outer electrodes and the electrodes 206 and 208 may be considered as inner electrodes. The outer electrodes 202 and 204 are located farther from the center of curvature of the ion guide 200 than the inner electrodes 206 and 208. As described further below, in one implementation the electrodes 202, 204, 206 and 208 function not only as ion guiding electrodes but also as ion deflecting electrodes. This may be accomplished by generating a direct (DC) voltage differential between the outer electrodes 202 and 204 and the inner electrodes 206 and 208, whereby a static DC ion deflecting field is oriented in the direction along the radius of curvature R to bias ions generally toward the center of curvature (i.e., generally away from the outer electrodes 202 and 204 and generally toward the inner electrodes 206 and 208).

Figure 3:
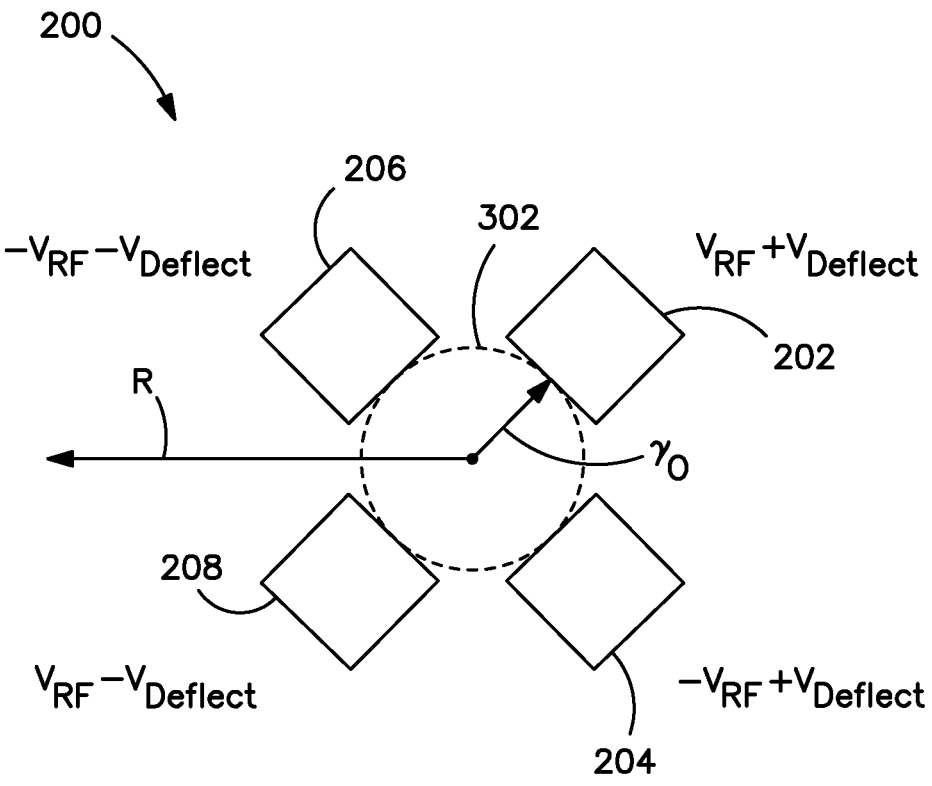
FIG. 3 is a simplified cross-sectional view of an example of a set of electrodes provided in the ion guide illustrated in FIG. 2.

As also illustrated by example in FIG. 2, the cross-section (orthogonal to the central z-axis) of each electrode 202, 204, 206 and 208 is such that the outer surface of each electrode 202, 204, 206 and 208 includes at least a curved portion 212, 214, 216 and 218, respectively, facing the interior space (or ion guiding region) generally defined between the opposing electrodes 202,208 and 204,206. The apex of the curve describing each curved portion 212, 214, 216 and 218 is typically the point on the outer surface closest to the central z-axis. Ideally for the purpose of generating a balanced quadrupolar field, each curved portion 212, 214, 216 and 218 has a hyperbolic profile. In the illustrated example, the electrodes 202, 204, 206 and 208 may be configured as elongated, cylindrical rods to provide a lower-cost approximation of hyperbolic electrode surfaces. The cross-sections of the electrodes 202, 204, 206 and 208 may be solid or complete as in the case of the solid cylinders illustrated in FIG. 2. Alternatively, the electrodes 202, 204, 206 and 208 may be formed from rectilinearly shaped cross-sections or plates, which may be bent to form hyperbolic or semi-circular outer surface portions 212, 214, 216 and 218 or may be flat or planar. For example, in another implementation the electrodes 202, 204, 206 and 208 may have square cross-sections as illustrated in FIG. 3. In this latter case, the electrodes 202, 204, 206 and 208 may be oriented such that a flat side of each electrode 202, 204, 206 and 208 faces inward toward the interior space (or ion guiding region) of the ion guide 200. For example, the electrodes may by configured as shown in U.S. Pat. No. 6,576,897, assigned to the assignee of the present disclosure.

FIG. 3 is a cross-sectional view of the electrodes 202, 204, 206 and 208 of the ion guide 200. The electrodes 202, 204, 206 and 208 are symmetrically arranged along the central or z-axis 120, which is curved as described above and illustrated in FIG. 1. Conceptually, the electrodes 202, 204, 206 and 208 are arranged such that their outer surfaces cooperatively define a circle 302 of inscribed radius $r_0$ extending orthogonally from the central axis 120. A similar circle 302 would result in implementations such as shown in FIG. 2 where the electrodes 202, 204, 206 and 208 have curved outer profiles. The interior space of the ion guide 200, and the ion guiding region in which two-dimensional (radial) excursions of the ions are constrained by the applied RF focusing field, are generally defined within this inscribed circle 302. To generate the ion focusing or guiding field, a radio frequency (RF) voltage of the general form $V_{RF}\cos(\omega t)$ is applied to opposing pairs of interconnected electrodes 202, 208 and 204, 206, with the signal applied to the one electrode pair 202, 208 being 180 degrees out of phase with the signal applied to the other electrode pair 204, 206. The basic theories and applications respecting the generation of quadrupolar RF fields for ion focusing, guiding or trapping, as well as for mass filtering, ion fragmentation and other related processes, are well known and thus need not be detailed here.

In accordance with the present teachings, the ion guide 200 includes an ion deflecting device or means for applying an ion-deflecting DC electric field in addition to the ion-guiding RF electric field. The ion-deflecting field is applied by impressing a differential DC voltage across the ion guiding region of the ion guide 200, such that the ion-deflecting field is applied in a radial direction toward the center of the circular sector of the ion guide 200. Accordingly, the DC ion-deflecting field is oriented in the same x-y plane as the two-dimensional or radial RF ion-guiding field, which plane is orthogonal to the central z-axis. This may be accomplished through the use of at least one opposing pair of electrodes serving as ion-deflecting electrodes and appropriately positioned so as to generate the ion-deflecting field in a radial direction.

In the implementation illustrated in FIG. 3, the ion-deflecting field is applied along the radius of curvature R of the ion guide 200. This may be accomplished in the present example by utilizing the electrodes 202, 204, 206 and 208 not only as ion-guiding electrodes but also as ion-deflecting electrodes. Thus, the DC voltages are superposed on the RF voltages applied to the electrodes 202, 204, 206 and 208. Specifically, a DC voltage of a first magnitude is applied to the outer pair of electrodes 202 and 204, and a DC voltage of a second magnitude is applied to the inner pair of electrodes 206 and 208, the terms "outer" and "inner" again informing the relative radial positions of the electrodes 202, 204, 206 and 208 relative to the center of curvature of the curved ion guide 200. The first magnitude and the second magnitude differ by a selected amount so as to create the static (or direct) potential difference, with the respective signs or polarities of the first and second magnitudes being dependent on whether positive or negative ions are to be deflected. In the specific example illustrated in FIG. 3, the absolute value of the DC voltage magnitude, $V_{deflect}$, is the same for both the outer electrodes 202 and 204 and the inner electrodes 206 and 208 but are of opposite polarity. Thus, the magnitudes of the composite voltages applied to the electrodes 202, 204, 206 and 208 are, respectively, $V_{RF}+V_{deflect}$, $-V_{RF}+V_{deflect}$, $-V_{RF}-V_{deflect}$, and $V_{RF}-V_{deflect}$. The foregoing combination of voltage potentials is sufficient for deflecting positive ions away from the outer electrodes 202 and 204 as they are guided through the curved ion guiding region of the ion guide 200. It is readily seen how to modify the DC voltages so as to similarly deflect negative ions. Thus, in one aspect of the present example, the electrodes 202, 204, 206 and 208 may be considered as being a part of the ion deflecting device of the ion guide 200.

The radial DC electric field configured as described herein enables ions to be transmitted through the curved ion guide 200 efficiently at higher kinetic energies than previously practiced for this type of ion guide. The deflection forces imparted to the ions by the DC electric field compensate for high kinetic energy and assist in guiding the high-energy ions around the curved ion path established by the ion guide 200. Moreover, a larger bandwidth (i.e., a more extensive range of multiple masses) of ions may be transmitted simultaneously through the ion guide 200 while maintaining transmission efficiency. Even at higher kinetic energies and/or greater mass ranges, optimal ion transmission conditions and thus high instrument sensitivity may be maintained in the ion guide 200.

The strength of magnitude of the applied DC ion-defection voltage $V_{deflect}$ will generally be a function of the kinetic energy (KE) of the ions requiring the deflection force. In one example, the applied DC ion-defection voltage $V_{deflect}$ is set to be proportional to the ion kinetic energy (KE) and to the ratio of the distance across opposite electrodes 202 and 208 (or 204 and 206) to the radius of curvature R of the ion guide 200. In the symmetrical electrode arrangement illustrated in FIG. 3, the distance across opposing electrodes may be represented by a function proportional to the radius $r_0$ of the inscribed circle 302. Accordingly, in this example the absolute value of the applied DC ion-defection voltage may be set according to the following relation: $V_{deflect}=k\times KE\times(r_0/R)$, wherein k is a constant of proportionality dependent on the geometry and size (e.g., the cross-section and dimensions) of the electrodes 202, 204, 206 and 208.

Figure 4:
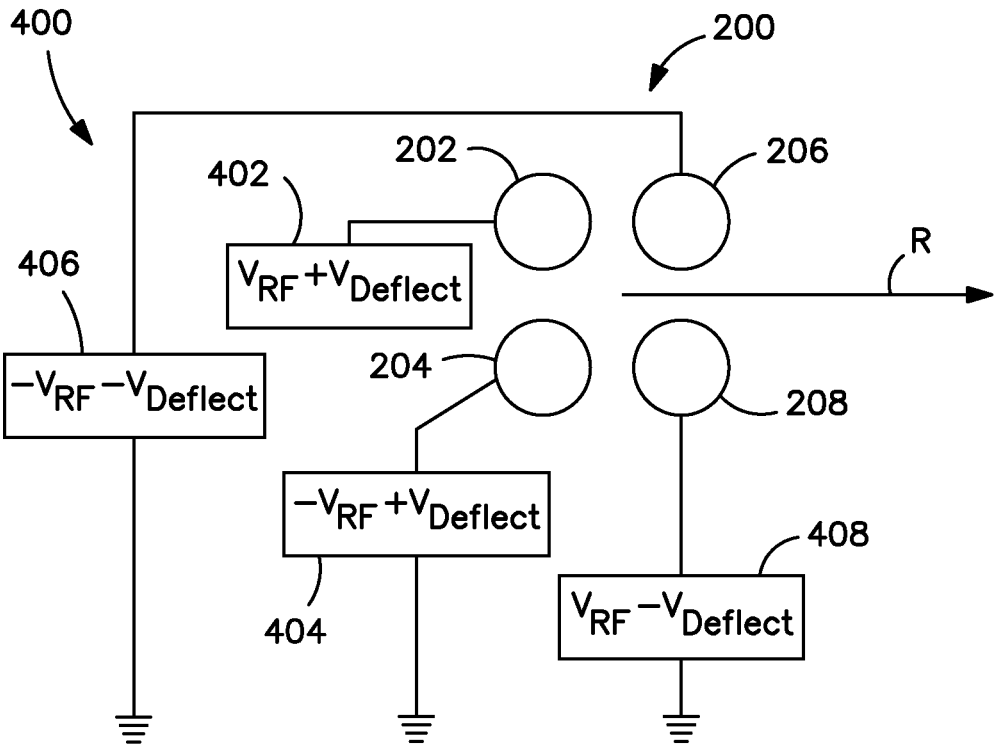
FIG. 4 is a simplified schematic view of an example of circuitry that may be provided with the ion guide illustrated in FIG. 2.

FIG. 4 is a simplified schematic view of an example of circuitry 400 that may be placed in communication with the electrodes 202, 204, 206 and 208 of the ion guide 200. The circuitry 400 generally includes a device or means for applying a two-dimensional (or radial) RF guiding field across the ion guide region defined within the arrangement of electrodes 202, 204, 206 and 208, and a device or means for applying a radial DC deflecting field across the ion guide region. These devices or means may be embodied in one or more DC and RF voltage sources or signal generators. It will be understood that such "sources" or "generators" may include hardware, firmware, analog and/or digital circuitry, and/or software as needed to implement the desired functions of the devices or means. The specific components and circuit elements utilized for implementing the DC and RF fields are appreciated by persons skilled in the art and thus are not detailed herein. FIG. 4 schematically groups the various RF and DC voltage sources into combined functional elements 402, 404, 406 and 408 placed in electrical signal communication with corresponding electrodes 202, 204, 206 and 208, thereby indicating the superposed RF and DC voltages applied, consistent with the example of FIG. 3. Thus, the voltage source 402 applies a composite voltage of $V_{RF}+V_{deflect}$ to the electrode 202, the voltage source 404 applies a composite voltage of $-V_{RF}+V_{deflect}$ to the electrode 204, the voltage source 406 applies a composite voltage of $-V_{RF}-V_{deflect}$ to the electrode 206, and the voltage source 408 applies a composite voltage of $V_{RF}-V_{deflect}$ to the electrode 208. It will also be understood that the circuitry 400 associated with the ion guide 200 may include an electronic controller (not shown), for example, one or more computing or electronic-processing devices. Such an electronic controller may be configured for controlling the operating parameters of the various voltage sources 402, 404, 406 and 408 utilized to apply the RF and DC fields. The electronic controller may also coordinate the operation of the ion guide 200 with other operative components of an ion processing system of which the ion guide 200 may be a part, such as the ion processing system 110 illustrated in FIG. 1.

In addition to the radial DC electric field, an axial DC electric field may be applied to the ion guide 200 along the central axis to control ion energy (e.g., axial ion velocity). An axial DC electric field may be particularly desirable in a case where ions being transmitted through the ion guide 200 experience collisions with neutral gas molecules (e.g., background gas). As appreciated by persons skilled in the art, such collisions may be employed for ion fragmentation or for collisional cooling. A DC voltage source or sources may be utilized to generate the axial DC electric field. The DC voltage source or sources may communicate with one or more of the electrodes 202, 204, 206 and 208 or with an external field generating device such as, for example, one or more other conductive members (e.g., resistive traces) positioned along the ion guide axis 120, such as outside the top and/or bottom of the ion guide 200, and/or between the top electrodes 202 and 206 and/or the bottom electrodes 204 and 208, etc. This "axial" DC voltage source may be conceptualized as being a part of one or more of the functional elements 402, 404, 406 and 408 schematically depicted in FIG. 4.

Figure 5:
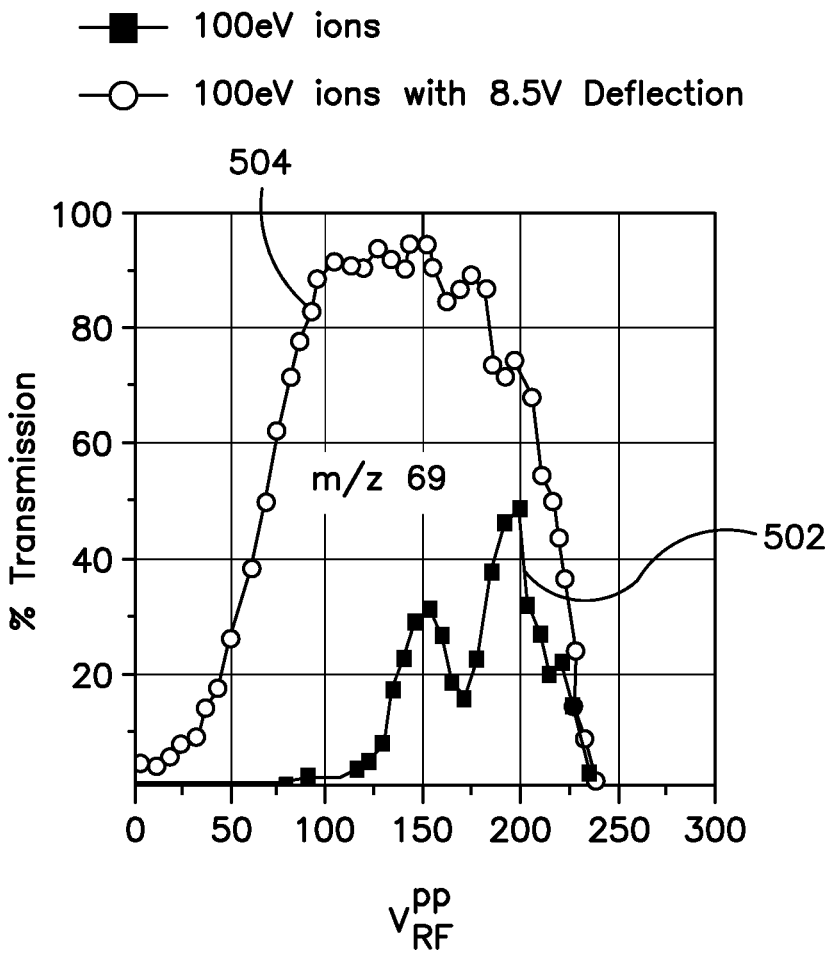
FIG. 5 is a plot of ion transmission efficiency (% transmission) as a function of peak-to-peak RF voltage ($V_{RF}^{pp}$) applied to a curved ion guide provided in accordance with certain implementations of the present disclosure.

FIG. 5 is a plot of ion transmission efficiency (% transmission) as a function of peak-to-peak RF voltage ($V_{RF}^{pp}$) applied to a curved ion guide structured similarly to the ion guide 200 described above and illustrated in FIGS. 2-4. Comparative data from two events 502 and 504 were acquired from computer simulations (SIMION®). In each event 502 and 504, ions having a mass-to-charge ratio (m/z) of 69 were transmitted through the curved ion guide with a kinetic energy of 100 eV. In the first event 502, no DC deflection field was applied. In the second event 504, an 8.5 V DC deflection field was applied. The improvement in ion transmission efficiency resulting from the DC deflection field, at any RF ion-guiding voltage that may applied to the curved ion guide, is clearly evident in FIG. 5.

Figure 6:
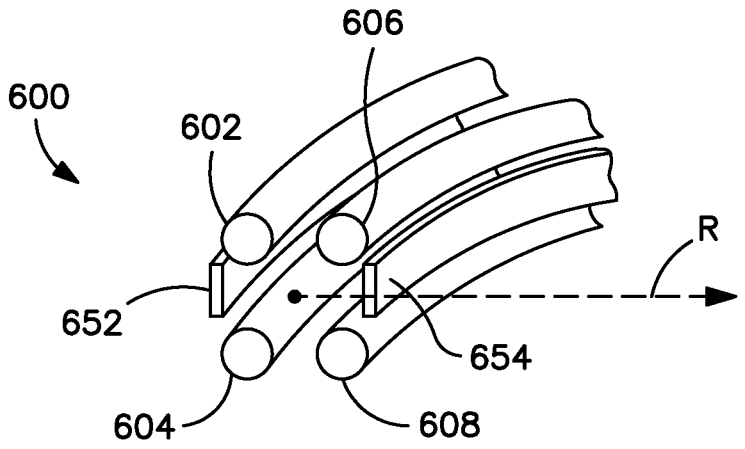
FIG. 6 is a perspective view of an example of a portion of an ion guide configured according to an alternative implementation of the present disclosure.

FIG. 6 is a perspective view of an example of a portion of an ion guide 600 configured according to an alternative implementation. The ion guide 600 may, for example, be utilized as the ion guide 100 described above and illustrated in FIG. 1 and as part of the accompanying the ion processing system 110. In this example, the electrode set of the ion guide 600 includes four parallel, curved ion guiding electrodes 602, 604, 606 and 608 to form a basic two-dimensional, quadrupolar ion-focusing (or ion-guiding) field, with the understanding that additional ion guiding electrodes may be included as mentioned previously. The ion guiding electrodes 602, 604, 606 and 608 may be arranged relative to the central z-axis in the same manner as described above in conjunction with FIGS. 2 and 3. Thus, the electrode set may be considered as including a pair of opposing, interconnected electrodes 602 and 608 and another pair of opposing, interconnected electrodes 604 and 606. Moreover, relative to the radius of curvature R, the electrode set may be considered as including a pair of outer electrodes 602 and 604 and a pair of inner electrodes 606 and 608.

In the present example illustrated in FIG. 6, the ion guide 600 includes an ion deflection device that includes a pair of curved, parallel ion deflecting electrodes 652 and 654, which are provided in addition to the ion guiding electrodes 602, 604, 606 and 608. The ion deflecting electrodes 652 and 654 are arranged in parallel with each other and with the central z-axis. Hence, the deflecting electrodes 652 and 654 may also be parallel with the ion guiding electrodes 602, 604, 606 and 608. The ion deflecting electrodes 652 and 654 are positioned in alignment with the radius of curvature R, which is to say that the radius of curvature R or an extension thereof passes orthogonally through the ion deflecting electrodes 652 and 654. The ion deflecting electrodes 652 and 654 may be located in the ion guide 600 so as not to interfere with the ion guide region defined within the interior of the ion guide 600 by the ion guiding electrodes 602, 604, 606 and 608, and so as not to interfere with the electrodynamic RF focusing field established by the ion guiding electrodes 602, 604, 606 and 608. Thus, in the illustrated example, the ion deflecting electrodes 652 and 654 are located outside of the ion guide region. The outer ion deflecting electrode 652 is located farther away (at a greater radial distance) from the center of curvature of the ion guide 600 than the outer ion guiding electrodes 602 and 604, and the inner ion deflecting electrode 654 is located closer (at a lesser radial distance) to the center of curvature than the inner ion guiding electrodes 606 and 608. As also shown in the example of FIG. 6, the ion deflecting electrodes 652 and 654 may have rectilinear cross-sections such that their outer surfaces facing the interior of the ion guide 600 are planar or flat rather than curved, whereby the ion deflecting electrodes 652 and 654 are constructed as elongated bands or strips of electrically conductive material.

In the present example, the ion guide 600 deflects ions by generating a direct (DC) voltage differential between the ion deflecting electrodes 652 and 654, whereby a static DC ion deflecting field is oriented in the direction along the radius of curvature to bias ions generally toward the center of curvature (i.e., generally away from the outer electrodes 602 and 604 and generally toward the inner electrodes 606 and 608). The magnitudes and polarities of the applied DC voltages may be as described above in conjunction with the implementations and examples associated with the ion guide 200.

Figure 7:
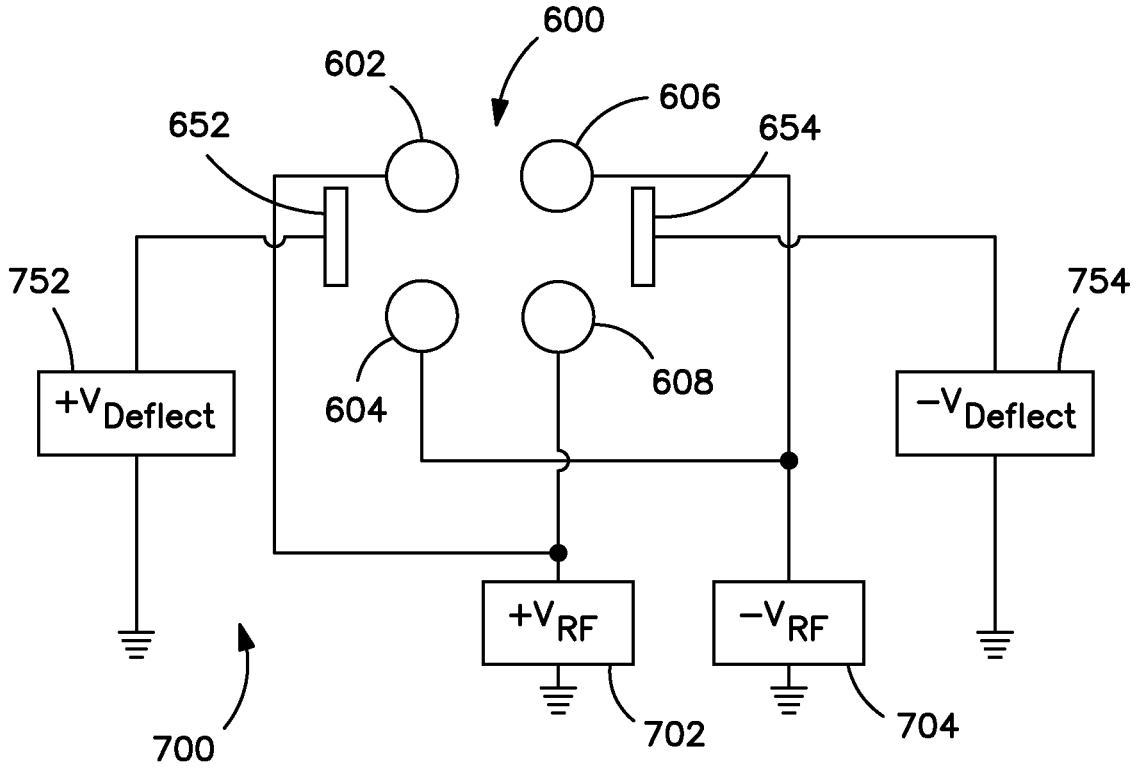
FIG. 7 is a simplified schematic view of an example of circuitry that may be provided with the ion guide illustrated in FIG. 6.

FIG. 7 is a simplified schematic view of an example of circuitry 700 that may be placed in communication with the ion guiding electrodes 602, 604, 606 and 608 and the ion deflecting electrodes 652 and 654 of the ion guide 200. The circuitry 700 generally includes a device or means for applying a two-dimensional (or radial) RF guiding field across the ion guide region defined within the arrangement of ion guiding electrodes 602, 604, 606 and 608, and a device or means for applying a radial DC deflecting field across the ion guide region. These devices or means may be embodied in one or more DC and RF voltage sources, signal generators, or the like. Because the present implementation provides a pair of electrodes 652 and 654 dedicated for establishing the radial DC deflecting field, only RF voltage sources need to be placed in signal communication with the ion guiding electrodes 602, 604, 606 and 608, and only DC voltage sources need to be placed in signal communication with the ion deflecting electrodes 652 and 654. Thus, in the schematic representation of FIG. 7, a voltage source 702 applies a voltage of $+V_{RF}$ to the interconnected pair of ion guiding electrodes 602 and 608, a voltage source 704 applies a voltage of $-V_{RF}$ to the interconnected pair of ion guiding electrodes 604 and 606, a voltage source 752 applies a voltage of $+V_{deflect}$ to the outer ion deflecting electrode 652, and a voltage source 754 applies a voltage of $-V_{deflect}$ to the inner ion deflecting electrode 654. It will be understood that the polarities of the DC voltage sources 752 and 754 may be switched for negative ions. The ion guide 600 provides advantages and benefits similar to the previously described ion guide 200.

As noted above in conjunction with FIG. 4, an axial DC electric field may be applied to the ion guide 600 along the central axis in addition to the radial DC electric field.

The ion guides 100, 200 and 600 disclosed herein may be utilized in any process, apparatus, device, instrument, system or the like for which a curved focused ion beam is contemplated for guiding ions from a given source to a given destination. The ion processing system 110 schematically depicted in FIG. 1 represents any of the foregoing environments in which the ion guide 100 (or 200 or 600) may operate. Thus, for example, the ion processing system 110 may generally include one or more upstream devices 172 and 174 and/or one or more downstream devices 176 and 178. The ion processing system 110 may be a mass spectrometry (MS) system (or apparatus, device, etc.) configured to perform a desired MS technique (e.g., single-stage MS, tandem MS or MS/MS, $MS^n$, etc.). Thus, as a further example, the upstream device 172 may be an ion source and the downstream device 178 may be an ion detector, and the other devices 174 and 176 may represent one or more other components such as ion storage or trapping devices, mass sorting or analyzing devices, collision cells or other fragmenting devices, ion optics and other ion guiding devices, etc. Thus, for example, the ion guide 100 may be utilized before a mass analyzer (e.g., as a Q0 device), or itself as an RF/DC mass analyzer, or as a collision cell positioned after a first mass analyzer and before a second mass analyzer. Accordingly, the ion guide may be evacuated, or may be operated in a regime where collisions occur between ions and gas molecules (e.g., as a Q0 device in a high-vacuum GC/MS, or a Q0 device in the source region of an LC/MS, or a Q2 device, etc.).

It will be understood that the methods and apparatus described in the present disclosure may be implemented in an ion processing system such as an MS system as generally described above by way of example. The present subject matter, however, is not limited to the specific ion processing systems illustrated herein or to the specific arrangement of circuitry and components illustrated herein. Moreover, the present subject matter is not limited to MS-based applications, as previously noted.

In general, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion guide comprising:

a plurality of curved electrodes arranged in parallel with each other and with a central curved axis, the curved central axis being co-extensive with an arc of a circular section having a radius of curvature, each electrode being radially spaced from the curved central axis, wherein the plurality of electrodes define a curved ion guide region arranged about the curved central axis and between opposing pairs of the electrodes; and an ion deflecting device configured for applying a radial DC electric field across the ion guide region and along the radius of curvature.

2. The ion guide of claim 1, wherein the ion deflecting device comprises a DC voltage source communicating with at least one pair of the plurality of electrodes.

3. The ion guide of claim 1, further comprising an axial DC voltage source configured for applying an axial DC electric field along the curved central axis.

4. The ion guide of claim 1, further comprising an RF voltage generator communicating with at least one opposing pair of the plurality of electrodes.

5. The ion guide of claim 1, wherein the plurality of curved electrodes comprises a pair of outer electrodes and a pair of inner electrodes, the outer electrode pair is positioned radially outwardly from the inner electrode pair relative to the radius of curvature, the ion deflecting device comprises a DC voltage source communicating with each electrode of the outer pair and the inner pair, and the DC voltage source is configured for applying a DC voltage of a first magnitude to the outer electrode pair and a DC voltage of a second magnitude to the inner electrode pair.

6. The ion guide of claim 5, wherein the DC voltage source is configured for applying the DC voltage to the outer electrode pair with a given polarity and the DC voltage to the inner electrode pair with the opposite polarity relative to a voltage at the curved central axis.

7. The ion guide of claim 1, wherein the plurality of curved electrodes comprises a first pair of opposing ion guiding electrodes and a second pair of opposing ion guiding electrodes, and the ion deflecting device comprises a pair of opposing, curved ion deflecting electrodes, the ion deflecting electrodes being arranged in parallel with each other and with the curved central axis and positioned along the direction of the radius of curvature.

8. The ion guide of claim 7, wherein the ion deflecting device further comprises a DC voltage source configured for applying a DC voltage of a first magnitude to one of the ion deflecting electrodes and a DC voltage of a second magnitude to the other ion deflecting electrode.

9. The ion guide of claim 8, wherein the DC voltage source is configured for applying the DC voltage to the one ion deflecting electrode with a given polarity and the DC voltage to the other ion deflecting electrode with the opposite polarity relative to a voltage at the curved central axis.

10. The ion guide of claim 7, further comprising an RF voltage generator communicating with at least one of the pairs of ion guiding electrodes.

11. The ion guide of claim 7, wherein the ion deflecting electrodes are positioned outside the ion guide region.

12. The ion guide of claim 1, wherein the ion deflecting device is configured for applying a the DC voltage having a magnitude of absolute value ($V_{deflect}$) proportional to the kinetic energy (KE) of the ion, the inscribed radius ($r_0$) of the plurality of electrodes about the central axis, and the radius of curvature (R), according to the relation $V_{deflect}=k\times KE\times(r_0/R)$, and wherein k is a constant of proportionality dependent on the cross-section and dimensions of the plurality of electrodes.

13. A collision cell comprising the ion guide of claim 1.

14. A method for guiding an ion through an ion guide, the method comprising:

transmitting the ion into a curved ion guide region of the ion guide, the ion guide region being defined by a plurality of curved electrodes arranged in parallel with each other and with a central curved axis, the curved central axis running through the ion guide region co-extensively with an arc of a circular section having a radius of curvature, each electrode being radially spaced from the curved central axis, wherein the curved ion guide region is arranged about the curved central axis and between opposing pairs of the electrodes;

generating a radio-frequency electric field across the ion guide region to focus the ion to motions generally along the curved central axis; and generating a radial DC electric field across the ion guide region and along the radius of curvature to provide an ion deflecting force directed along the radius of curvature.

15. The method of claim 14, wherein generating the DC electric field comprising applying a DC voltage potential to at least one pair of the plurality of electrodes.

16. The method of claim 14, further comprising generating an axial DC electric field along the curved central axis for controlling axial ion velocity.

17. The method of claim 14, wherein the plurality of curved electrodes comprises a pair of outer electrodes and a pair of inner electrodes, the outer electrode pair is positioned radially outwardly from the inner electrode pair relative to the radius of curvature, and generating the DC electric field comprises applying a DC voltage of a first magnitude to the outer electrode pair and a DC voltage of a second magnitude to the inner electrode pair to create a DC potential difference between the outer electrode pair and the inner electrode pair.

18. The method of claim 17, wherein generating the DC electric field comprises applying the DC voltage to the outer electrode pair with a given polarity and the DC voltage to the inner electrode pair with the opposite polarity relative to a voltage at the curved central axis.

19. The method of claim 14, wherein the plurality of curved electrodes comprises a first pair of opposing ion guiding electrodes and a second pair of opposing ion guiding electrodes, generating the radio-frequency electric field comprises applying a radio-frequency voltage potential to two or more of the ion guiding electrodes, and generating the DC electric field comprises applying a DC voltage potential between a pair of opposing, curved ion deflecting electrodes, the ion deflecting electrodes being arranged in parallel with each other and with the curved central axis and positioned along the direction of the radius of curvature.

20. The method of claim 14, wherein generating the DC electric field comprises applying a DC voltage having a magnitude of absolute value ($V_{deflect}$) proportional to the kinetic energy (KE) of the ion, the inscribed radius ($r_0$) of the plurality of electrodes about the central axis, and the radius of curvature (R), according to the relation $V_{deflect}=k\times KE\times(r_0/R)$, and wherein k is a constant of proportionality dependent on the cross-section and dimensions of the plurality of electrodes.

21. The method of claim 14, further comprising evacuating the ion guide and mass-analyzing the ion in relation to one or more ions of different masses transmitted into the ion guide region, or introducing gas molecules into the ion guide and colliding the ion with one or more of the gas molecules.

* * * * *

UNITED STATES PATENT AND TRADEMARK OFFICE

CERTIFICATE OF CORRECTION

PATENT NO. : 9,236,235 B2
APPLICATION NO. : 12/277198
DATED : January 12, 2016
INVENTOR(S) : Felician Muntean et al.

It is certified that error appears in the above-identified patent and that said Letters Patent is hereby corrected as shown below:

In the Specification

In column 5, line 31-32, delete "may by" and insert -- may be --, therefor.

In the Claims

In column 11, line 14, in claim 12, delete "a the" and insert -- a --, therefor.

Signed and Sealed this
Twelfth Day of July, 2016

Michelle K. Lee

Michelle K. Lee
*Director of the United States Patent and Trademark Office*